US007125314B2

(12) United States Patent
Shibata

(10) Patent No.: US 7,125,314 B2
(45) Date of Patent: Oct. 24, 2006

(54) EYEGLASS LENS PROCESSING APPARATUS

(75) Inventor: Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/240,367

(22) Filed: Oct. 3, 2005

(65) Prior Publication Data

US 2006/0073772 A1 Apr. 6, 2006

(30) Foreign Application Priority Data

Oct. 1, 2004 (JP) ..... P2004-290766

(51) Int. Cl.
*B24B 49/00* (2006.01)

(52) U.S. Cl. ..... 451/5; 451/42

(58) Field of Classification Search ..... 451/5, 451/6, 8, 42–44, 240, 255, 256, 277
See application file for complete search history.

(56) References Cited

U.S. PATENT DOCUMENTS

RE35,898 E 9/1998 Shibata et al.
6,220,926 B1 * 4/2001 Mizuno ..... 451/5
6,325,700 B1 * 12/2001 Mizuno et al. ..... 451/8
6,328,628 B1 * 12/2001 Mizuno et al. ..... 451/5
6,350,190 B1 * 2/2002 Matsuyama ..... 451/384
6,478,657 B1 * 11/2002 Shibata ..... 451/5
6,702,653 B1 * 3/2004 Shibata ..... 451/42
6,790,124 B1 * 9/2004 Shibata ..... 451/5
6,942,542 B1 * 9/2005 Shibata ..... 451/5

FOREIGN PATENT DOCUMENTS

EP 1 591 199 A2 11/2005

* cited by examiner

*Primary Examiner*—Dung Van Nguyen
(74) *Attorney, Agent, or Firm*—Sughrue Mion, PLLC

(57) ABSTRACT

An eyeglass lens processing apparatus for processing a lens to fit the lens into a rim, includes: an edge measurement portion that measures a path of an edge position of the chucked lens based on a 2-D outline shape is a projection shape of the rum in its warp direction and a layout of the optical center of the chucked lens; and an arithmetic operation portion that obtains an inclination angle of the edge path or a temporary bevel path obtained based on the edge path with respect to a center axis, obtains a corrected 2-D outline shape which is a projection shape onto a plane perpendicular to the center axis based on the inclination angle and the 2-D outline shape, and obtains a final bevel path to form a bevel in the periphery of the lens chucked at the optical center based on the corrected 2-D outline shape.

7 Claims, 10 Drawing Sheets

EYEGLASS LENS PROCESSING APPARATUS

BACKGROUND OF THE INVENTION

The present invention relates to an eyeglass lens processing apparatus for processing a periphery of an eyeglass lens.

In a processing process forming a bevel at a periphery of an eyeglass lens in order to fit the lens into a rim of an eyeglass frame, the shape of the rim is measured three-dimensionally and the 2-D outline shape (two-dimensional outline shape) and the 3-D circumference (three-dimensional circumference) of the rim are obtained based on the measured 3-D shape (three-dimensional shape) of the rim. The obtained 2-D outline shape and the obtained 3-D circumference of the rim are input to an eyeglass lens processing apparatus. In the eyeglass lens processing apparatus, the path of the edge position of the lens chucked and held by a lens chuck shaft is measured based on the input 2-D outline shape and the path of the bevel apex position is obtained based on the measured edge path. The obtained bevel path is corrected (circumference-corrected) so that the 3-D circumference of the bevel path will match the input 3-D circumference, thereby forming the bevel on the periphery of the lens based on the corrected bevel path.

There is a method for obtaining the 2-D outline shape assumed in case the bevel path is obtained as mentioned above, as a projection shape of the rim in its warp direction. With this method, in case a lens with a large lens curve undergoes boxing center chuck processing (processing in which a lens is processed while being chucked and held by the lens chuck shaft at the geometrical center (the boxing center) of the 2-D outline shape) to tailor the lens to a rim with a large warp, a change in the shape caused by warp is small even if the circumference correction is executed on the obtained bevel path, which leads to high-precision processing.

The method for obtaining the 2-D outline shape as the projection shape of the rim in its warp direction is effective in the boxing center chuck processing alone. In case a lens with a large lens curve undergoes optical center chuck processing (processing in which a lens is processed while being chucked and held by a lens chuck shaft at the optical center of the lens), the larger the lens curve of the lens is, or the larger the warp of the rim is, the larger the change in the shape caused by circumference correction becomes. This makes it difficult to perform high-precision processing.

In view of the related art problems, an object of the invention is to provide an eyeglass lens processing apparatus capable of performing high-precision processing even in case a lens with a large lens curve undergoes optical center chuck processing to tailor the lens to a rim with a large warp.

SUMMARY OF THE INVENTION

In order to solve the aforesaid object, the invention is characterized by having the following arrangement.

(1) An eyeglass lens processing apparatus for processing a periphery of an eyeglass lens to fit the eyeglass lens into a rim of an eyeglass frame, comprising:

a chuck shaft that chucks and holds the lens;

an input portion that inputs a 2-D outline shape which is a projection shape of the rum in its warp direction and a layout of an optical center of the lens with respect to the 2-D outline shape;

an edge measurement portion that measures a path of an edge position of the lens chucked and held by the chuck shaft based on the input 2-D outline shape and the input layout of the optical center; and an arithmetic operation portion that obtains an inclination angle of the measured edge path or a temporary bevel path obtained based on the measured edge path with respect to a center axis of the chuck shaft, obtains a corrected 2-D outline shape which is a projection shape onto a plane perpendicular to the center axis of the chuck shaft based on the obtained inclination angle and the input 2-D outline shape, and obtains a final bevel path to form a bevel in the periphery of the lens chucked and held by the chuck shaft at the optical center based on the obtained corrected 2-D outline shape.

(2) The eyeglass lens processing apparatus according to (1), wherein the arithmetic operation portion obtains a curve sphere of the edge path or the temporary bevel path, obtains a 3-D shape formed on the curve sphere by projecting the 2-D outline shape onto the curve sphere from a direction of the inclination angle to convert the 3-D shape into coordinates using a direction of the center axis of the chuck shaft as a reference based on the layout of the optical center and the inclination angle, and obtains the corrected 2-D outline shape by projecting the obtained 3-D shape onto the plane perpendicular to the center axis of the chuck shaft.

(3) The eyeglass lens processing apparatus according to (2), wherein the arithmetic operation portion corrects the layout of the optical center to a layout seen from the direction of the center axis of the chuck shaft based on the curve sphere and the inclination angle and determines a reference point for projecting the 2-D outline shape onto the curve sphere based on the corrected layout.

(4) The eyeglass lens processing apparatus according to (1), wherein the arithmetic operation portion arranges the 2-D outline shape inclined by the inclination angle with respect to the central axis of the chuck shaft and obtains the corrected 2-D outline shape by projecting the arranged 2-D outline shape onto the plane perpendicular to the center axis of the chuck shaft in.

(5) The eyeglass lens processing apparatus according to (1), wherein the edge measurement portion re-measures the path of the edge position of the lens chucked and held by the chuck shaft at the optical center based on the obtained corrected 2-D outline shape and the arithmetic operation portion obtains the final bevel path based on the re-measured edge path.

(6) An eyeglass lens processing apparatus for processing a periphery of an eyeglass lens to fit the lens into a rim of an eyeglass frame, comprising:

a chuck shaft that chucks and holds the lens;

an input portion that inputs a 2-D outline shape which is a projection shape of the rim in a predetermined direction and a layout of an optical center of the lens with respect to the 2-D outline shape;

an edge measurement portion that measures a path of an edge position of the lens chucked and held by the chuck shaft based on the input 2-D outline shape and the layout of the optical center; and an arithmetic operation portion that obtains an inclination angle of a projection direction of the 2-D outline shape with respect to a center axis of the chuck shaft based on the measured edge path, obtains a corrected 2-D outline shape which is a projection shape onto a plane perpendicular to the center axis of the chuck shaft based on the 2-D outline shape arranged in a direction of the obtained inclination angle, and obtains a bevel path to form a bevel in the periphery of the lens chucked and held by the chuck shaft at the optical center based on the obtained corrected 2-D outline shape.

(7) The eyeglass lens processing apparatus according to (6), wherein the edge measurement portion re-measures the path of the edge position of the lens chucked and held by the chuck shaft at the optical center based on the obtained corrected 2-D outline shape and the arithmetic operation portion obtains the bevel path based on the re-measured edge path.

DETAILED DESCRIPTION OF PREFERRED EMBODIMENTS

Figure 1:
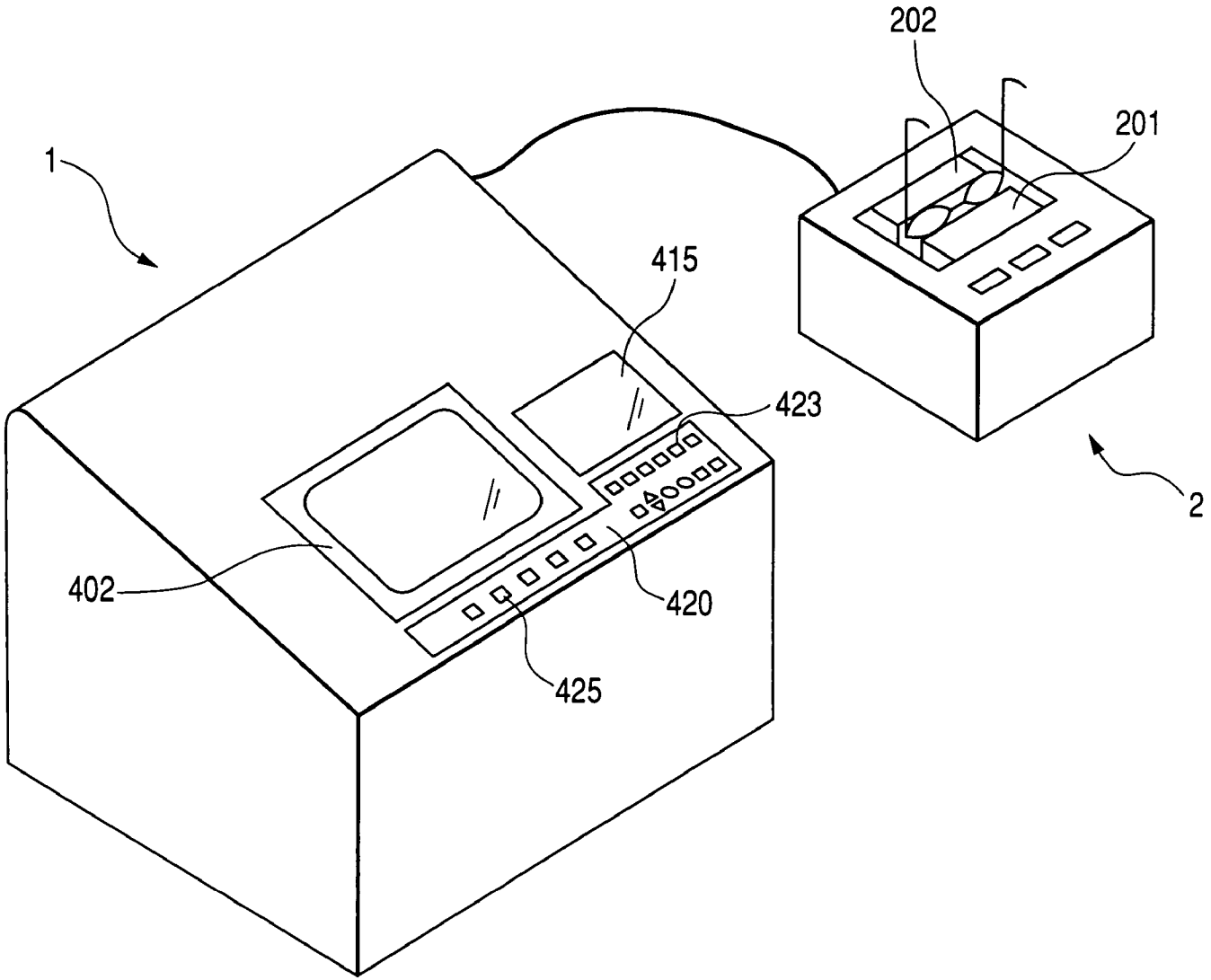
FIG. 1 is a schematic external view of an eyeglass lens processing apparatus according to an embodiment of the invention.

An embodiment of the invention will be described based on drawings. FIG. 1 is a schematic external view of an eyeglass lens processing apparatus according to en embodiment of the invention. A frame shape measurement apparatus 2 is connected to an eyeglass lens processing apparatus body 1. A display 415 for displaying processing information, and a switch panel 420 having several switches for inputting processing conditions and processing instructions are arranged on the top of the processing apparatus body 1. A processing chamber in which a processing portion mentioned later is arranged is provided inside an opening/closing window 402. The measurement apparatus 2 is described for example in U.S. Pat. No. 6,325,700 (JP-A-2000-314617). The eyeglass frame is chucked and held by two sliders 201, 202. The measurement apparatus 2 may be integrated with the processing apparatus body 1.

Figure 2:
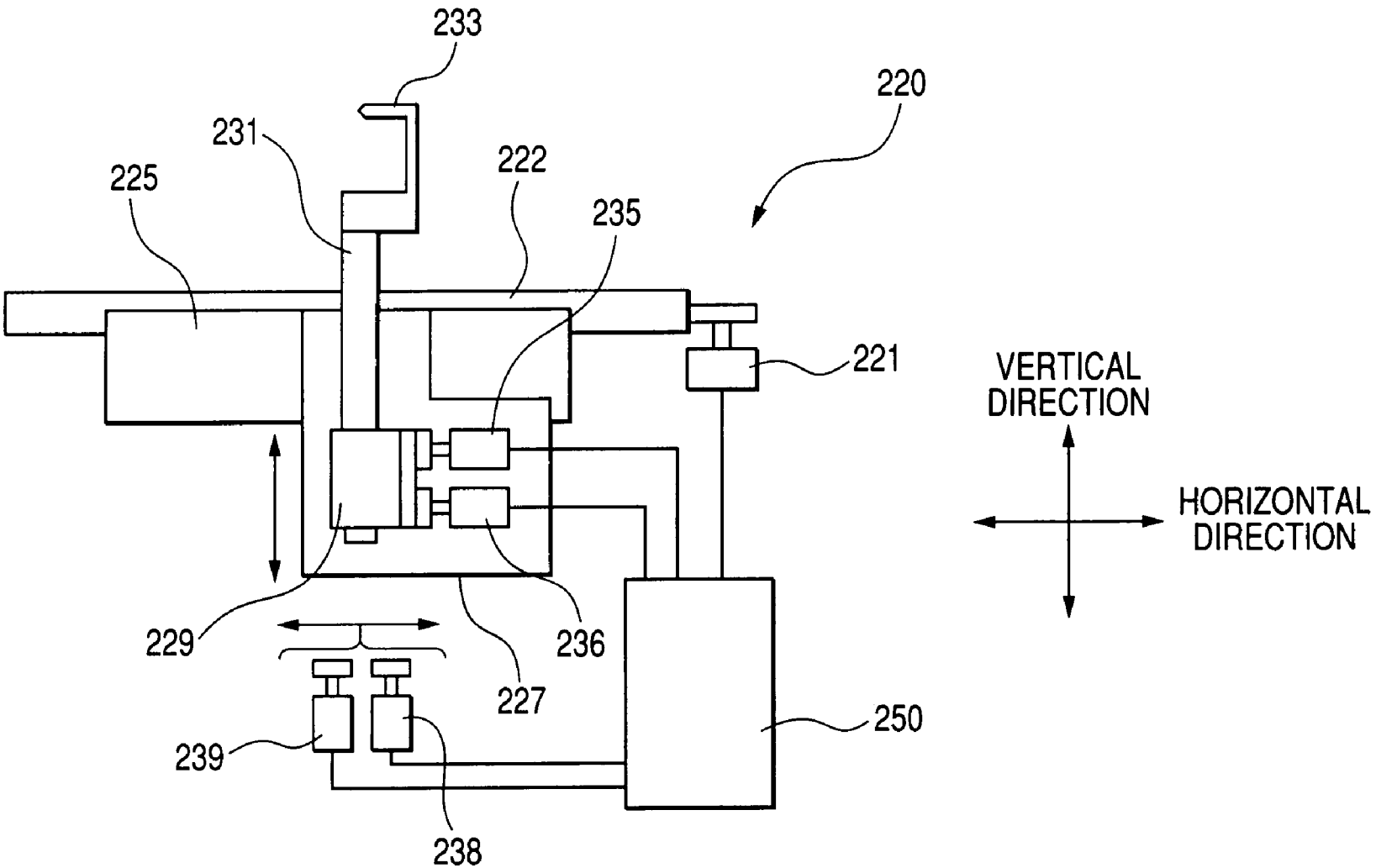
FIG. 2 is a schematic block diagram of a measurement portion arranged in a frame shape measurement apparatus.

FIG. 2 is a schematic block diagram of a measurement portion 220 arranged in the measurement apparatus 2. The measurement portion 220 includes: a rotary base 222 rotated horizontally by a pulse motor 221; a fixed block 225 fixed to the base 222; a horizontal movement supporting base 227 supported by the block 225 and moved in horizontal direction by a motor 238; a vertical movement supporting base 229 supported by the movement supporting base 227 and moved in vertical direction by a motor 235; a measurement stylus shaft 231 rotatably held by the movement supporting base 229; a measurement stylus attached to the top end of the shaft 231, with its tip located on the center axis of the shaft 231; an encoder 239 for detecting the movement amount of the movement supporting base; and an encoder 236 for detecting the movement amount of the movement supporting base 229. The motors and the encoders are connected to an arithmetic operation controller 250.

Measurement is started after a frame is chucked and held by and fixed to sliders 201, 202. An arithmetic operation portion 250 drives the motors 235, 238 and causes the tip of the stylus 233 to come into contact with the inner groove of one of the rims of the frame. Then, the arithmetic operation portion 250 rotates the motor 251 per predetermined unit rotation pulse count. This rotation moves the stylus 233 and the movement supporting base 227 in horizontal direction along the radius vector of the rim and the movement amount is detected by the encoder 239. The stylus 233 and the movement supporting base 229 are moved in vertical direction along the warp of the rim and the movement amount is detected by the encoder 236. Based on the rotation angle (radial angle) θ of the base 222 by the motor 221, the radial length r detected by the encoder 239 and the warp amount z detected by the encoder 136, the 3-D shape of the inner groove of the rim is measured as (Rn, θn, zn) (n=1, 2, . . . , N). This measurement is also made for the other rim. The arithmetic operation portion 250 measures the left and right rims and obtains the boxing center distance FPD between the boxing centers of the left and right rims. For the 3-D shape of the left and right rims, the 3-D shape of one rim may be mirror-inverted and used as the 3-D shape of the other rim.

Figure 3:
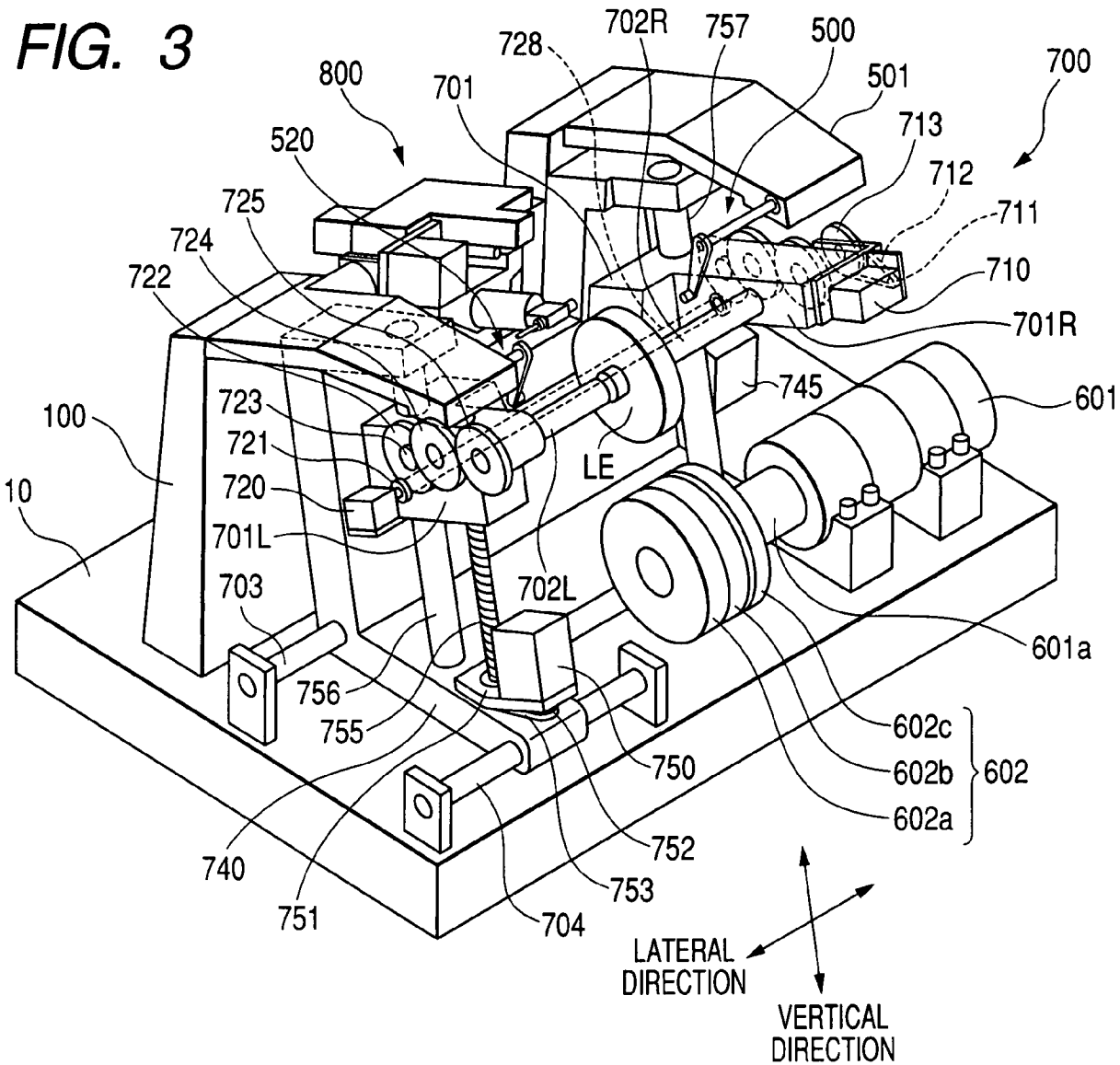
FIG. 3 is a schematic block diagram of a processing portion arranged in the processing apparatus body.

FIG. 3 is a schematic block diagram of a processing portion arranged in the processing apparatus body 1. A carriage part 700 is mounted on the base 10. A lens to be processed LE is chucked and held by lens shuck shafts (lens rotation shafts) 702L, 702R and ground by an abrasive wheel (grindstone) group 602 attached to an abrasive wheel rotation shaft 601*a* rotated by a abrasive wheel rotation motor 601. The abrasive wheel group 602 includes a rough abrasive wheel 602*a* for glasses, a rough abrasive wheel 602*b* for plastics and a fine abrasive wheel 602*c* for beveling and flat processing.

A lens shape measurement portions 500, 520 are arranged above the carriage part 700. A boring/chamfering/grooving part 800 is arranged at the rear of the carriage 700.

(I) Carriage part

<Lens chuck mechanism and lens rotation mechanism>

A chuck shaft 702L and a chuck shaft 702R are rotatably held on the same axis on the left arm 701L and right arm 701R of the carriage 701 in the carriage part 700, respectively. A chuck motor 710 is fixed to the front face of the right arm 701R. The torque of the motor 710 is transmitted to a pulley 713 via a pulley 711 and a belt 712 attached to the rotation shaft of the motor 710. This causes the chuck shaft 702R to be moved in its center axis direction (hereinafter also referred to as the chuck axis direction) via a feed screw and a feed nut (these are not shown) rotatably held inside the right arm 701R, and causes the lens LE to be chucked and held by the chuck shafts 702L, 702R.

A lens rotation motor 720 is fixed to the left end of the left arm 701L. The torque of the motor 720 is transmitted to the chuck shaft 702L via gears 721 through 725. The torque of the motor 720 is also transmitted to the chuck shaft 702R via a rotation shaft 728 rotatably held behind the carriage 701 and the gear at the right end of the right arm 701R. This causes the chuck shafts 702L, 702R to rotate synchronously about respective center axes (chuck axis).

<Carriage movement mechanism>

A movement supporting base 740 is supported by the carriage shafts 703, 704 fixed to the base 10 slidably in the direction of their center axes. A lateral movement motor 745 is fixed to the base 10. The torque of the motor 745 is transmitted to the movement supporting base 740 via a ball screw (not shown) extending in parallel with the shaft 703 behind the movement supporting base 740. This causes the carriage to move laterally together with the movement supporting base 740.

A carriage 710 is supported by shafts 756, 757 fixed to the movement supporting base 740 extending in vertical direction (direction that causes the center axis distance between the chuck shafts 702L, 703R and the shaft 601*a* to vary) slidably in the direction of their center axes. A vertical movement motor 750 is fixed to the movement supporting base 740 via a plate 751. The torque of the motor 750 is transmitted to a ball screw 755 rotatably held on the plate 751 via a pulley 752 and a belt 753 attached to the rotation shaft of the motor 750. This causes the ball screw to rotate and the carriage 701 to move in vertical direction (that is, the center distance between the chuck shafts 702L, 703R and the shaft 601*a* varies).

(b) Lens shape measurement portion

Figure 4:
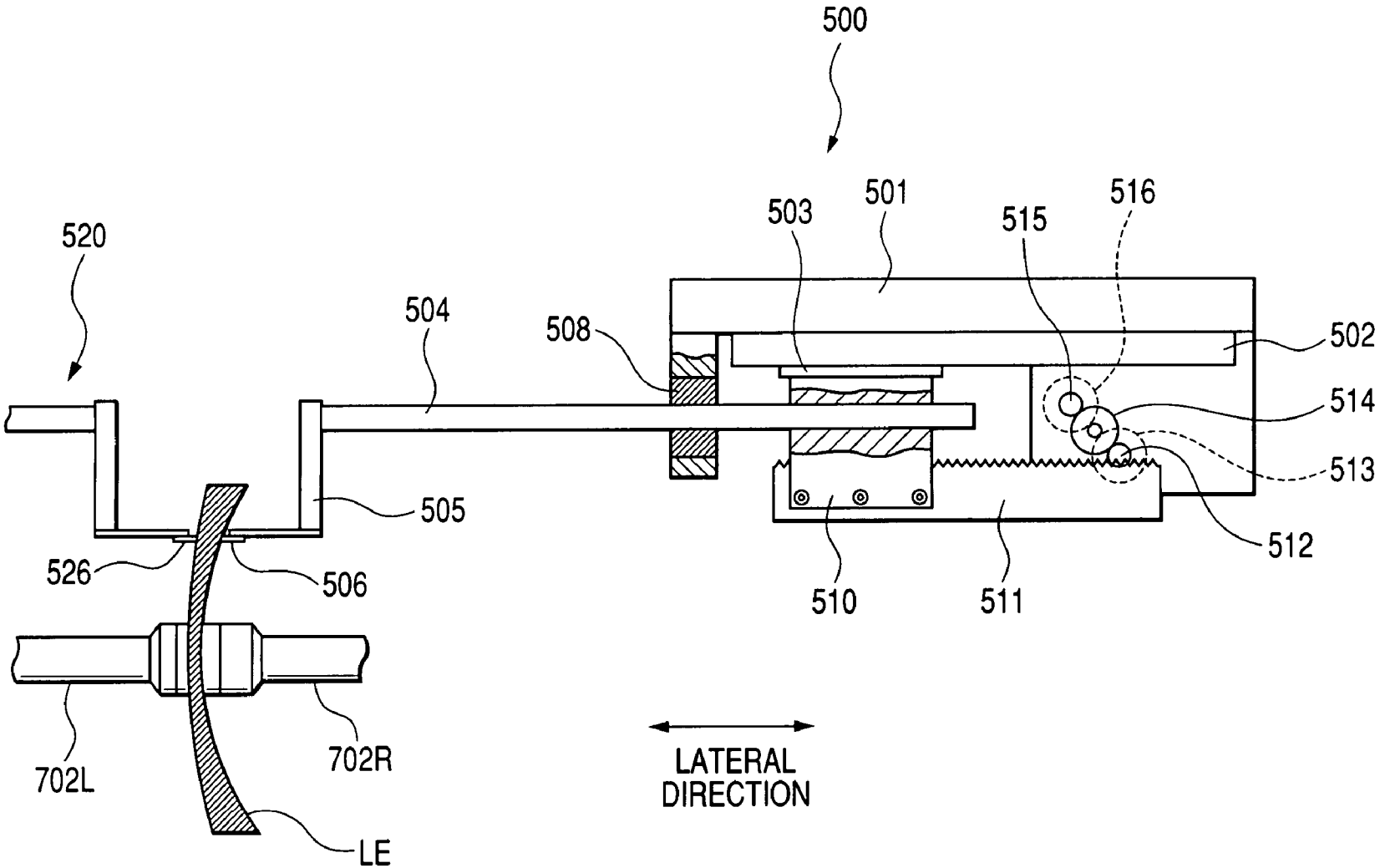
FIG. 4 is a schematic block diagram of a lens rear face shape measurement portion arranged in the processing apparatus body.

FIG. 4 is a schematic block diagram of a lens rear face shape measurement portion 500 for measuring the path of the edge position of a lens. A supporting base 501 (refer to FIG. 2) is fixed to the sub base erected on the base 10. A measurement feeler arm 504 is fixed to the slide base 510. A ball bush 508 is fitted in the side face of the supporting base 501 in order to eliminate backlash in the arm 504. An L-shaped measurement feeler hand 505 is fixed to the tip of the arm 504. A disc-shaped measurement feeler 506 is attached to the tip of the hand 505. In the measurement of the rear face shape of the lens LE, the feeler 506 comes in contact with the rear face of the lens LE.

A rack 511 is fixed to the bottom of the slide base 510. The rack 511 is engaged with a pinion 512 of the encoder 513 fixed to the supporting base 501. A motor 516 is fixed to the supporting base 501. The torque of the motor 516 is transmitted to the rack 511 via a gear 515, an idle gear 514 and a pinion 513 attached to the rotation shaft of the motor 516. This causes the slide base 510 and an arm 504 to move laterally. During measurement of the lens shape, the motor 516 presses the feeler 506 against the lens LE with a constant force. The encoder 513 detects the lateral movement amount of the slide base 510 (position of the feeler 506). The movement amount (position) and the rotation angle of the chuck shaft 702L, 702R are used to measure the rear face shape of the lens LE.

A lens front face shape measurement portion 520 is symmetrical with respect to the lens rear face shape measurement portion 500 so that the corresponding configuration is not described.

Figure 5:
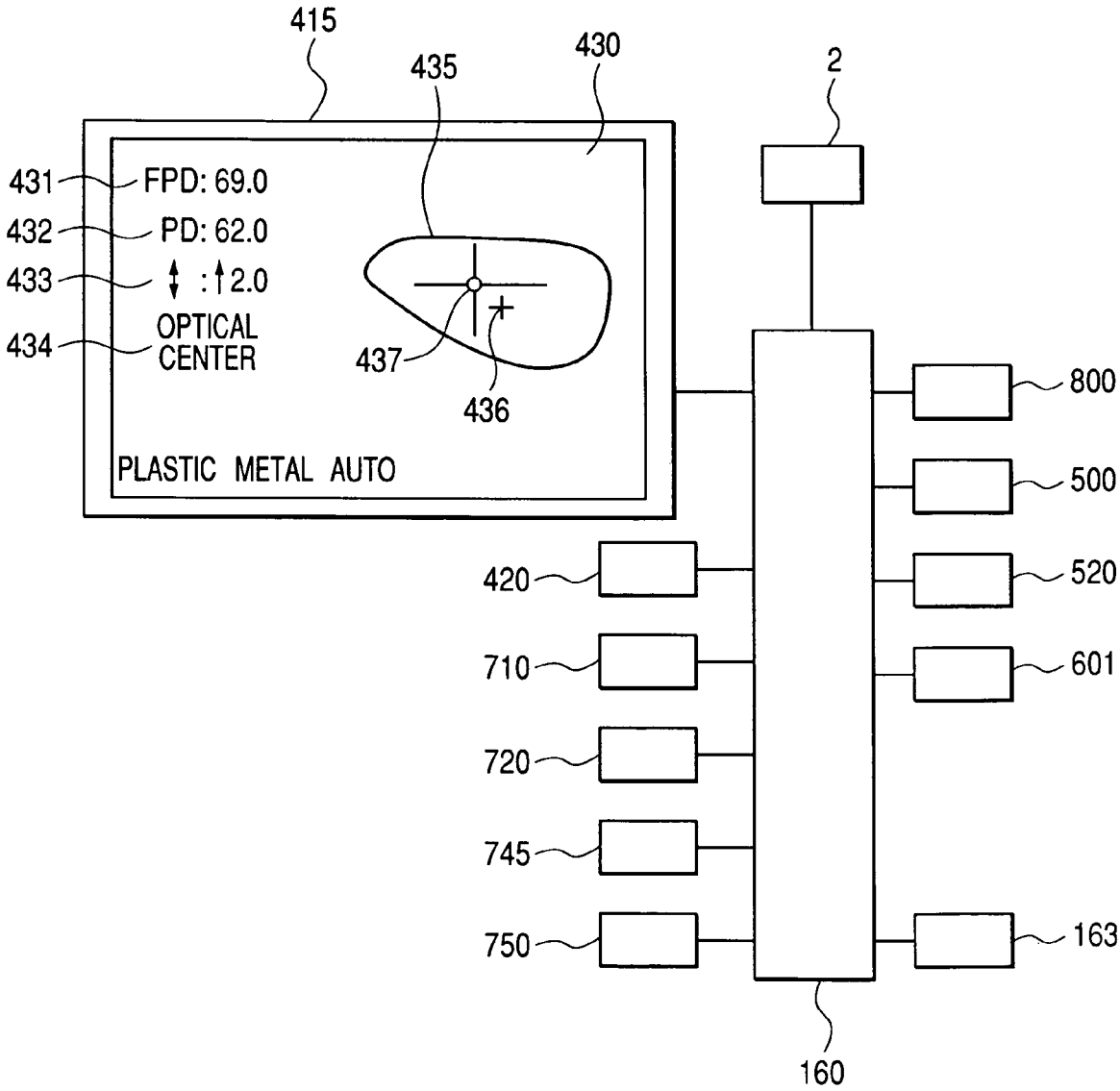
FIG. 5 is a schematic block diagram of a control system of the processing apparatus body 1.

FIG. 5 is a schematic block diagram of the control system of the processing apparatus body 1. With referring to FIG. 5, operation of the process will be described in which a lens LE with a large lens curve undergoes optical center chuck processing to tailor the lens LE to a rim with a large warp.

The 3-D shape of the rim of the frame is measured by the measurement apparatus 2. When the frame is chucked and held by and fixed to the sliders 202, 202 and the arithmetic operation portion 250 operates the measurement portion 220, the 3-D shape of the inner groove of the rim (rn, θn, zn) (n=1, 2, . . . , N) is measured as mentioned above. In case the left and right rims are chucked and held by the sliders 201, 202 for measurement, the 2-D outline shape (rn, θn) (n=1, 2, . . . , N) obtained based on the obtained 3-D shape of the rim is a projection shape of the rim in its front direction (front direction in the frame wearing state). The 2-D outline shape may be used as it is. However, it is preferable to correct the 2-D outline shape to a 2-D outline shape that is a projection shape of the rim in its warp direction in order to eliminate the influence of warp of the rim.

Figure 6:
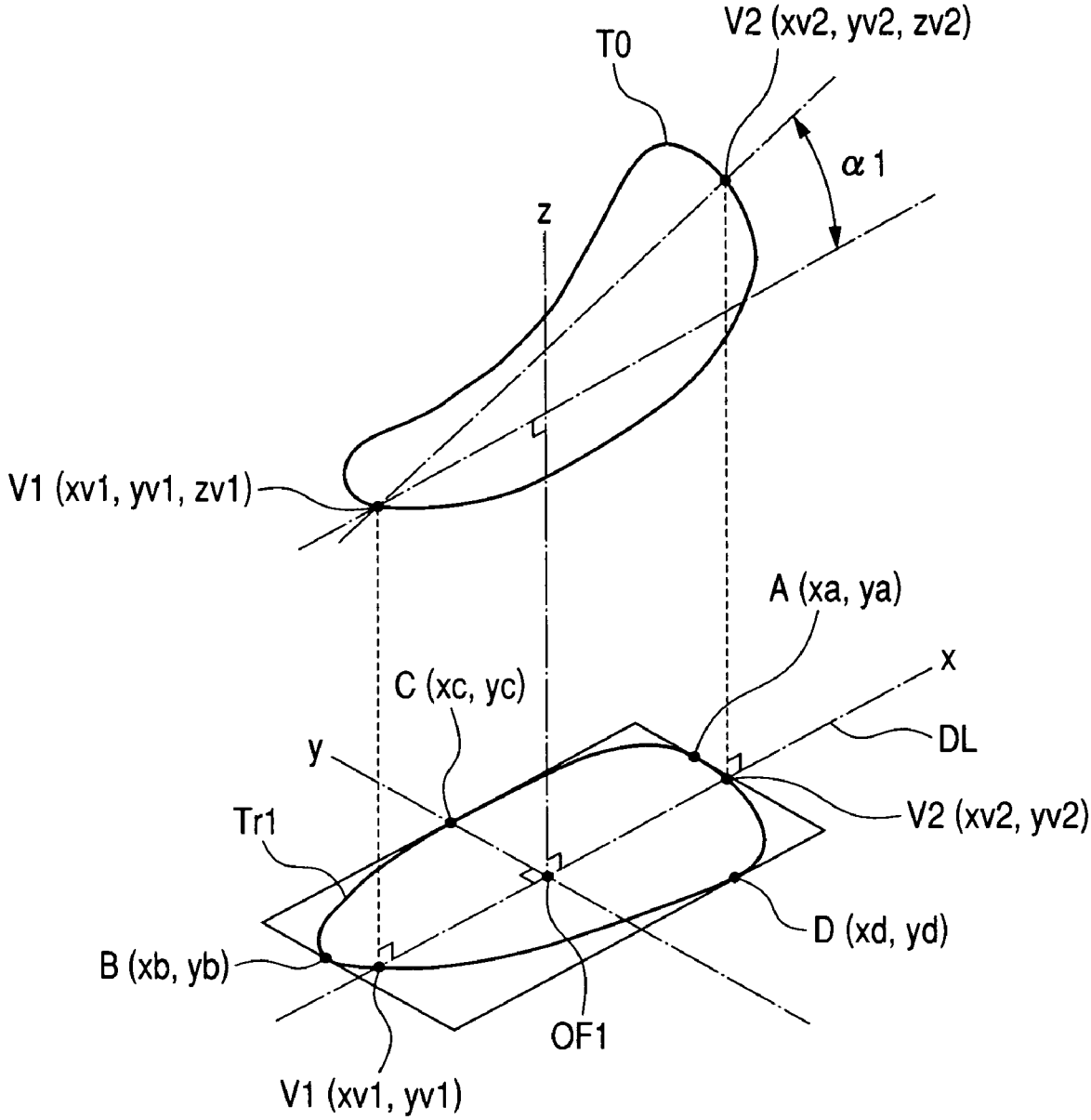
FIG. 6 illustrates a method for correction to a 2-D outline shape as a projection shape in the warp direction.
Figure 7:
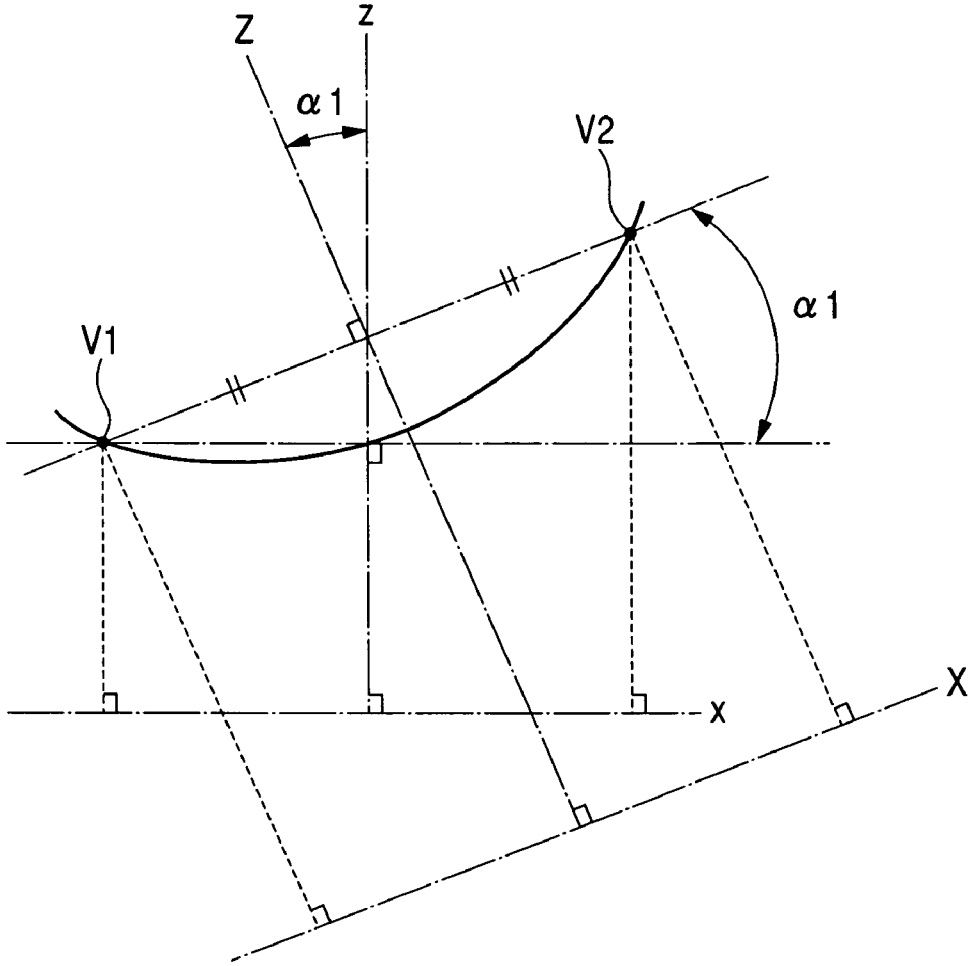
FIG. 7 illustrates the method for correction to the 2-D outline shape as the projection shape in the warp direction.
Figure 8:
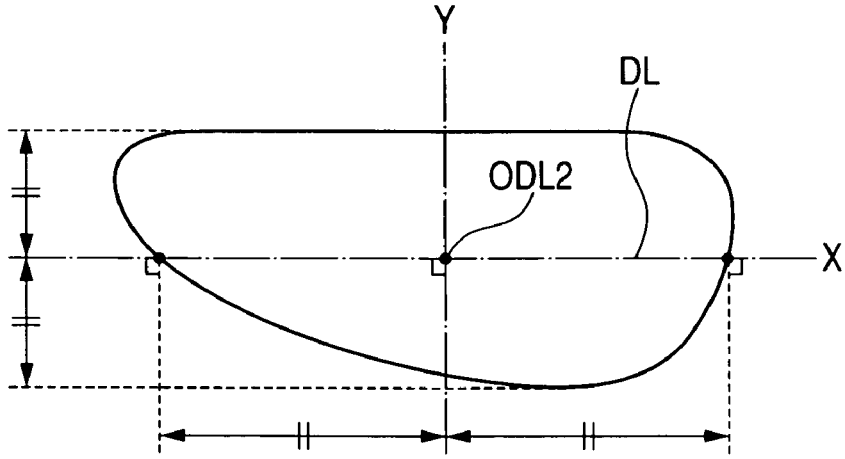
FIG. 8 shows the 2-D outline shape as the projection shape in the warp direction.

FIGS. 6 and 7 illustrate a method for correcting the 2-D outline shape to a 2-D outline shape that is a projection shape in the rim warp direction. In FIG. 6, T0 is a 3-D shape (rn, θn, zn) obtained through measurement. The arithmetic operation portion 250 converts the 3-D shape to orthogonal coordinate data (xn, yn, zn) (n=1, 2, . . . , N). Tr1 is a 2-D outline shape that is a projection shape onto the xy plane (2-D plane seen from the front). In the 2-D outline shape, a point A (xa, ya) having a maximum value in x-axis direction, a point B (xb, yb) having the minimum value in x-axis direction, a point C (xc, yc) having a maximum value in y-axis direction and a point D (xd, yd) having the minimum value in y-axis direction are selected and their boxing center is specified as OF1. A line in x-axis direction passing through the OF1 serves as a datum line DL. As well known in the eyeglass industry, the datum line is a horizontal line passing through the midpoint point of the highest point and lowest point of the outline in vertical direction (vertical direction in the frame wearing state). The warp of the rim uses as a reference the outline datum line DL assumed when the rim is seen from the front. For the 3-D shape T0 (xn, yn, zn) of the rim, a nose-side point in x-axis direction (minimum×value point) positioned on the datum line DL is assumed as V1 (xv1,yv1,zv1) and an ear-side point (maximum×value point) is assumed as V2 (xv2,yv2,zv2). The warp angle of the rim (datum line inclination angle) with respect to the datum line DL is assumed as α1. The direction of the x-axis inclined by the angle α1 is used as the new X-axis angle. The y-axis direction is used as Y-axis (inclination of the rim in vertical direction is almost negligible). The vertical bisector of a segment connecting the point V1 and the point V2 is used as the new Z-axis direction (refer to FIG. 7). The 3-D shape of the rim (xn,yn,zn) is converted into the 3-D shape (Xn,Yn,Zn) (n=1, 2, . . . N) of a new XYZ coordinate system. By projecting the 3-D shape (Xn,Yn,Zn) onto the XY plane, the 2-D outline shape (Xn,Yn) (N=1, 2, . . . , N) as a projection shape in the warp direction (datum line inclination angle direction) is obtained as shown in FIG. 8. The origin of the XY coordinate system for the 2-D outline shape is the center point on the datum line ODL2.

The arithmetic operation portion 250 obtains the distance between data items of the 3-D shape (Xn,Yn,Zn) or (xn,yn, zn) and sums them up to obtain the 3-D circumference FL of the rim.

When measurement by the measurement apparatus 2 is complete, upon a push on the data input (transfer) switch 423 arranged on the switch panel 420 of the processing apparatus body 1, the 2-D outline shape (Xn,Yn), the 3-D circumference FL and the datum line inclination angle α1 are input to the processing apparatus body 1 and stored in a memory 163. The display 415 shows a screen 430 for setting layout and processing conditions (refer to FIG. 5).

In the screen 430 on the display 415 of FIG. 5, an input field 431 is one for inputting a distance between boxing centers of the left and right rims. An input field 432 is used to input the distance between papillary centers of the eyeglass wearing person. An input field 433 is used to input the upward shift amount of the optical center of the lens LE with respect to the boxing center of the rim. A switch on the switch panel 420 is used to input the above layout data. An input field 434 is used to specify (select) either optical center chuck processing or boxing center chuck processing. Either of the two is selected using a switch on the switch panel 420. In this embodiment, optical center chuck processing is selected. On the right-hand side of the setting screen 430 is displayed a 2-D outline shape FIG. 435. Specification of the optical center chuck processing, the frame pupillary distance FPD, the pupillary distance PD and the upward shift amount are input to determine and display the boxing center 436 of the rim and the optical center 437 of the lens LE with respect to the boxing center 436. During measurement of a lens shape, the 2-D outline shape (Xn, Yn) is converted to polar coordinate data (Rn, θn) (n=1, 2, . . . , N) with respect to the optical center for later use.

A cup as a fixture is attached to the front face of the lens LE at the optical center. The cup is attached to a holder of the chuck shaft 703L and the lens LE is chucked and held at the optical center. When a start switch 425 is pressed, a main controller 160 operates the measurement portions 500, 520 to measure the shape of the front and rear face of the lens LE (path of edge position). In the measurement process, the lateral position of the feeler 506 is detected by the encoder 513 by controlling the vertical position of the carriage 701 and rotation of the lens LE based on the 2-D outline shape (Rn, θn) while causing the feeler 506 of the measurement portion 520 to be into contact with the rear face of the lens LE, thereby obtaining the edge path (Rn, θn, fzn) (n=1, 2, . . . , N) of the rear face of the lens LE. Similarly, the lateral position of the feeler 506 of the measurement portion 520 that is in contact with the front face of the lens LE is detected, thereby obtaining the edge path (Rn, θn, rzn) (n=1, 2, . . . N) of the front face of the lens LE.

In the following description, the chuck axis direction is assumed to be the z-axis direction at the processing apparatus body 1 and a plane perpendicular to the z-axis is assumed to be an xy plane. The xyz coordinate system for the processing apparatus body 1 is separate from that for the measurement apparatus 2.

When the shapes of the front and rear face of the lens LED are obtained, the main controller 160 obtains a temporary bevel path in accordance with the general procedure to calculate the path of the bevel apex position. For example, the temporary bevel path is obtained as the bevel apex path shifted from the front face to rear face of the lens LE for a certain amount, or the bevel apex path obtained by dividing the edge width of the lens LE using a certain ratio (such as a ratio of 3:7). Four points on the temporary bevel path are arbitrarily selected to obtain a radius vr of a bevel curve sphere where the four points are located and its center coordinates Ov (xv, yv, zv). Preferably, the radius vr and its center coordinates Ov (xv, yv, zv) are obtained from multiple sets of coordinates. Further, a bevel curve value Vcrv (typically 523 divided by the radius of the sphere) is obtained from the radius vr. Similarly, the radius fr of the curve sphere at the front of the lens LE and its center coordinates (xf, yf, zf) as well as a lens front face curve value Fcrv are obtained.

Assuming that the bevel path is corrected (circumference is corrected) so that the 3-D circumference of the bevel path will nearly match the 3-D circumference FL of the rim, in case a lens with a large lens curve is chucked and held at the optical center by the chuck shafts 702L, 702R, the lens LE is processed in a smaller size in vertical direction with respect to the 2-D outline shape. Thus, the 2-D outline shape is corrected as follows. In case the 2-D outline shape is corrected, it is practically acceptable even if the center coordinates of each of the bevel curve sphere and the lens front face curve sphere are on the chuck axis.

Figure 9:
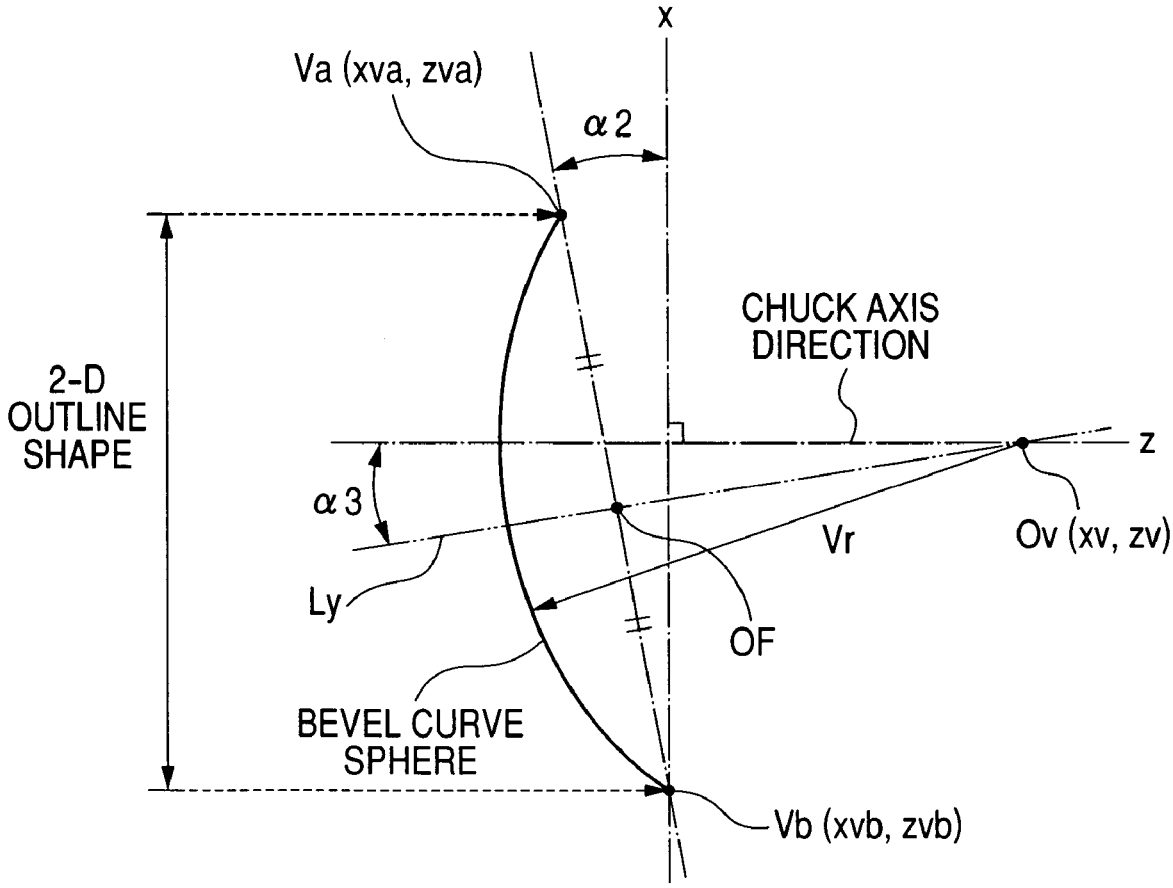
FIG. 9 illustrates a method for calculating the warp angle in processing and the inclination angle of the path of the bevel apex position.

When the shape of the lens LE is measured, the main controller 160 first obtains the warp angle in processing based on the bevel curve position on the datum line DL of the 2-D outline shape. In FIG. 9, the point Va is a nose-side position of a bevel curve positioned on the datum line DL of the 2-D outline shape (Rn, θn) and the point Vb is an ear-side position of the same. The main controller 160 obtains the angle as a warp angle α2 formed by a straight line connecting the point Va (xva,zva) and the point Vb (xvb,zvb) and the z-axis direction perpendicular to the chuck axis direction. The warp angle α2 is used to determine whether to perform warp correction in processing. In case the warp angle α2 is below a predetermined reference a angle (for example 5 degrees), the influence of warp is negligible so that warp correction is unnecessary.

Warp correction in processing will be described. The measured edge path or obtained temporary bevel path is used to obtain the inclination angle of the edge path or temporary bevel path with respect to the chuck axis direction. The following example uses the temporary bevel path in accordance with FIG. 9. In FIG. 9, the midpoint between the point Va and the point Vb positioned on the datum line DL of the 2-D outline shape (Rn, θn) is defined as OF. A straight line passing through the point OF and the center Ov of the bevel curve sphere is defined as Ly. An angle α3 formed by the chuck axis direction and the straight line Ly is defined as the inclination angle in x-axis direction of the temporary bevel path with respect to the chuck axis direction. While this calculation is done for the x-axis only in this example, it is preferable that the inclination angle of the temporary bevel path with respect to the chuck axis direction be obtained for the y-axis also and both inclination angle values be combined to obtain the inclination angle of the temporary bevel path with respect to the chuck axis direction. The inclination angle in the y-axis direction may be neglected without a practical error. Approximately, the warp angle α2 used for correction in processing may be considered to be the inclination angle α3 of the temporary bevel path.

In the warp correction in processing, the frame pupillary distance FPD and the pupillary distance PD are preferably corrected, and thus the correction will be described below with reference to FIGS. 10 and 11. Since the warp angle α1 is already obtained on the datum line DL, for easy calculation, the frame pupillary distance FPD is converted into the distance between centers on the datum line DL (hereinafter referred to as the datum FPD). In this practice, the 2-D outline shape (Xn,Yn) input from the measurement apparatus 2 is a projection shape in the warp direction (datum line inclination angle direction). The frame pupillary distance FPD is a distance on a three-dimensional path so that precise correction is not available in a strict sense although approximate correction may be made as follows.

Figure 10:
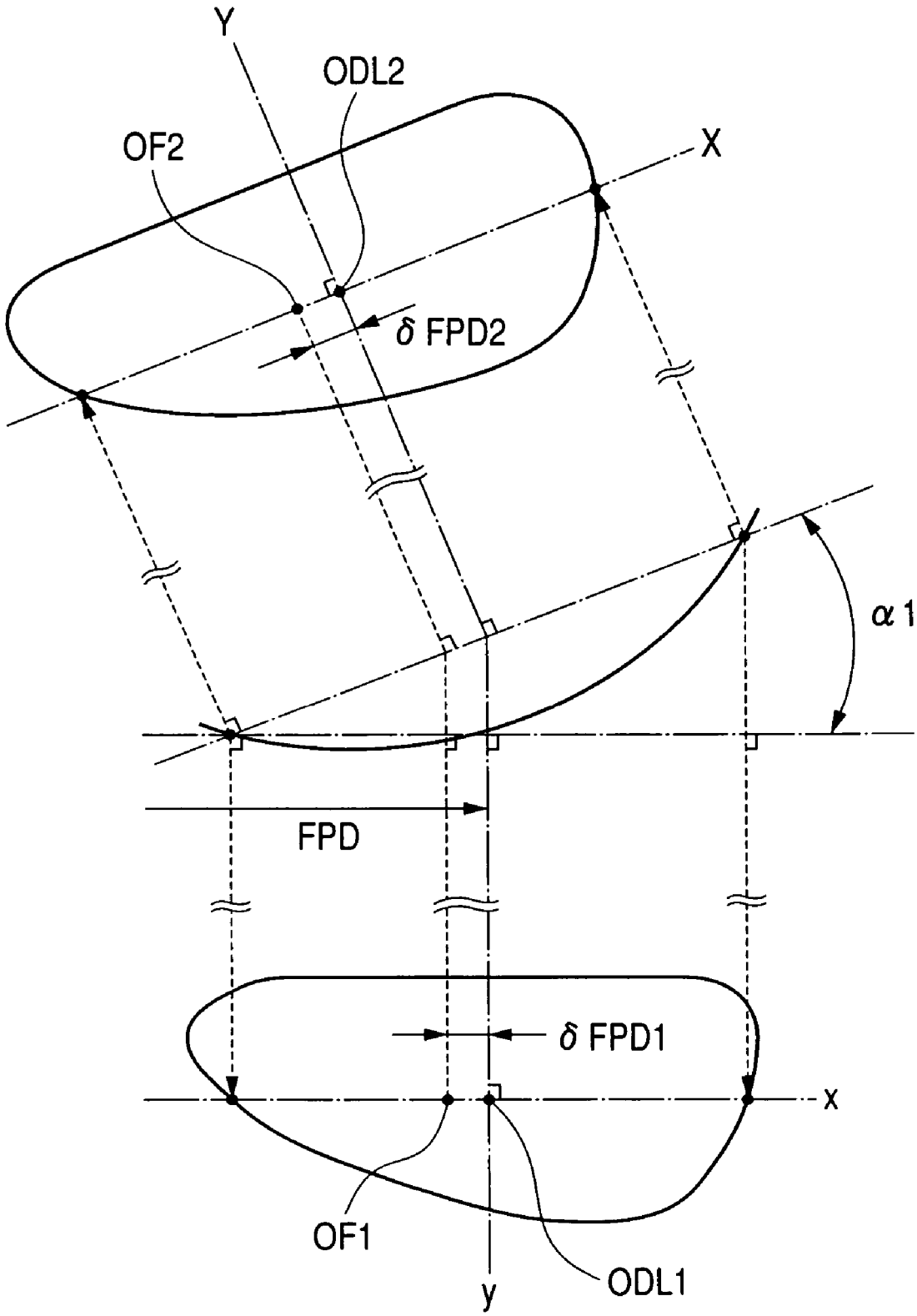
FIG. 10 illustrates a method for converting the distance between the boxing center of the left and right rims to the center distance on the datum line.

In FIG. 10, the distance between the boxing center OF1 of the 2-D outline shape as a projection shape of the rim in its front direction and the center ODL1 on the datum line is assumed as δFPD1. The distance between the boxing center OF2 of the 2-D outline shape as a projection shape of the rim in its warp direction and the center ODL2 on the datum line is assumed as δFPD2. From FIG. 10, δFPD2 is obtained from the following expression:

$$\delta FPD2=\delta FPD1/\cos \alpha 1$$

The single side datum FPD is obtained as FPD/2+δFPD2.

Next, correction of pupillary distance PD used to determine the optical center will be described. While various methods for correcting a pupillary distance PD are available, the approximation method will be described below. As shown in FIG. 11, assume a bevel curve sphere having a center Ov (xv, zv) and a radius vr obtained through lens shape measurement. Same as FIG. 9, the point Va is a nose-side point of a bevel curve positioned on the datum line DL and the point Vb is an ear-side position of the same. The straight line connecting the point Va and the point Vb is inclined at an angle of α1 with respect to the front direction. According to the specification of the pupillary distance PD, the papillary center PD of the bevel curve is assumed as OPD and z in this position is obtained from the bevel curve expression.

$$(x-xv)2+(z-zv)2=Vr2$$

The midpoint between the point Va and the point Vb is assumed as OF. The point of a straight line connecting the midpoint OF and the center Ov of the bevel curve sphere on the bevel curve sphere is assumed as OFPD. The distance ΔPD obtained by drawing a normal to the straight line passing through the point OPD and the center Ov of the bevel curve sphere from the point OFPD is the correction amount of the optical center (nose-side shift amount) in x-axis direction as seen from the chuck axis direction. While the same philosophy may be applicable to correction of the optical center in vertical direction, since the influence of the warp in vertical direction is negligible, the input optical center value may be used while skipping the correction process. The corrected optical center is used as new layout data.

Figure 12:
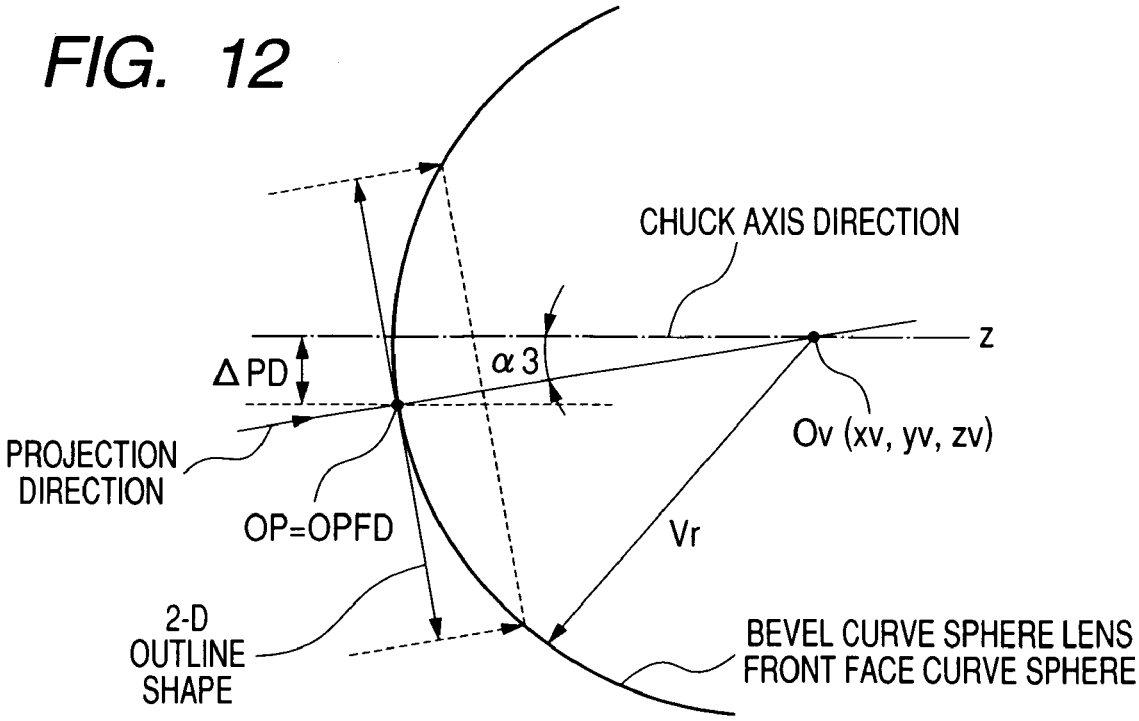
FIG. 12 illustrates a method for correcting a 2-D outline shape.

Next, the obtained inclination angle α3 and distance ΔPD are used to correct the 2-D outline shape to a shape seen from the chuck axis direction. As shown in FIG. 12, a bevel curve sphere having a center Ov and a radius Vr is assumed. A 2-D outline shape input from the measurement apparatus 2 is projected onto the bevel curve sphere from the inclination angle α3. In this case, the center Ov of the bevel curve sphere may be assumed to exist on the chuck axis with negligible practical errors, thus simplifying the calculation. The 2-D outline shape is projected so as to align the datum center OFPD of the 2-D outline shape at a position shifted toward the ear by the distance ΔPD from the axis shaft, based on the layout data of the optical center. That is, the position OP of the bevel curve sphere shifted by the layout data correction distance ΔPD from the chuck axis is used as a projection reference point. For the layout of the optical center in vertical direction, although it is preferable that the reference point for projection be shifted in vertical direction before starting projection, the shape may be shifted in vertical direction after the 2-D outline shape is projected with the shape shifted by the distance ΔPD in lateral direction, which leads negligible practical errors.

Next, the coordinates of a 3-D shape formed by projecting a 2-D outline shape onto a bevel curve sphere are obtained. By converting the coordinates into XY coordinates that uses the chuck axis direction as a new x-axis direction, the original 2-D outline shape is corrected to the 2-D outline shape seen from the chuck axis direction, that is, the 2-D outline shape (Xcon, Ycon) (n=1, 2, . . . , N) projected onto a plane perpendicular to the chuck axis direction. In this case, to simplify the calculation, coordinate conversion may be performed to set the projection direction of the 2-D outline shape in horizontal direction and perform coordinate conversion with the 2-D outline shape inclined after it is projected. The following arithmetic operations are mainly done by the main controller 160.

Figure 11:
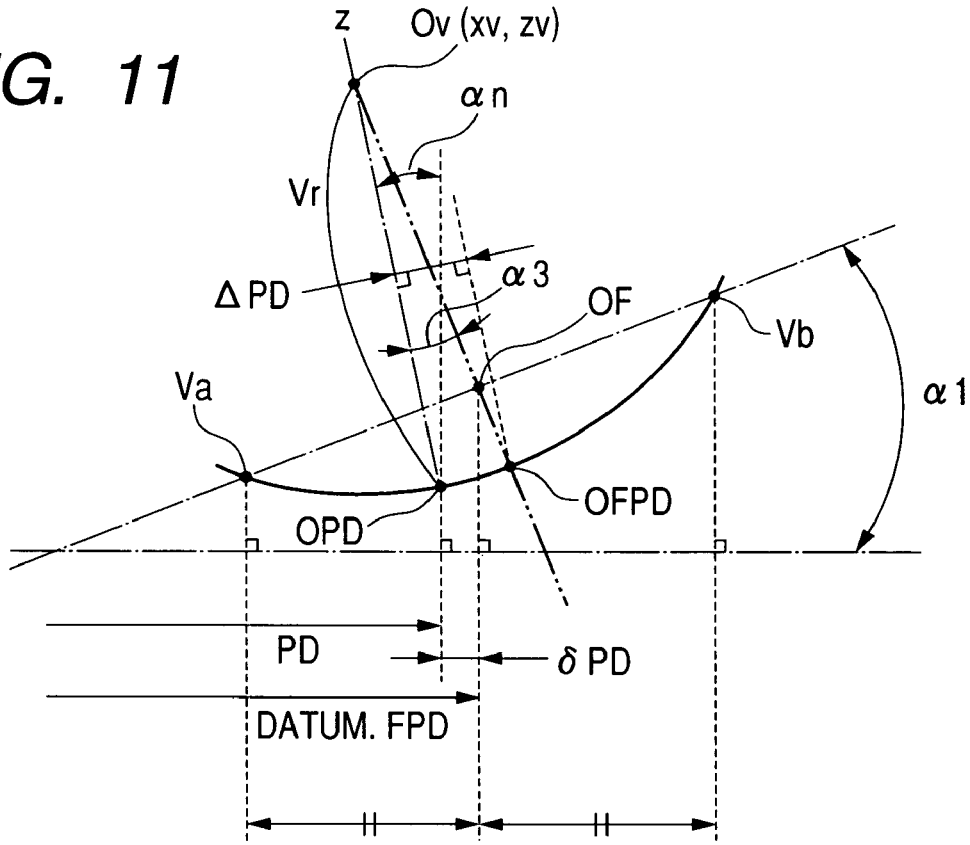
FIG. 11 illustrates a method for correcting a pupillary distance.

While correction of the pupillary distance PD described referring to FIG. 11 and correction of the 2-D outline shape described referring to FIG. 12 are done with taking a bevel curve sphere into account, a lens front face curve sphere based on the edge path of the lens front face may be employed. Use of the lens front face curve is preferred although it is possible to employ a lens rear face curve sphere based on the edge path of the lens rear face.

While correction to a 2-D outline shape seen from the chuck axis direction is preferably made by first projecting the 2-D outline shape onto a bevel curve sphere or a lens curve sphere as mentioned above, a simplified method may be used as follows. The inclination angle of the edge path or temporary bevel path α3 (including a case where the warp angle α2 is used) is used, and the 2-D outline shape (Xn,Yn) is arranged with being inclined by the angle α3 with respect to the chuck axis direction and the 2-D outline shape is projected onto a plane perpendicular to the chuck axis direction in order to correct the 2-D outline shape to a 2-D outline shape seen from the chuck axis direction (Xcon, Ycon) (n=1, 2, . . . , N). In actual calculation, Xn of the 2-D outline shape may be simply multiplied by cos αto obtain Xcon and, for Y-coordinate, Yn of the 2-D outline shape may be used as Ycon without correction.

When a corrected 2-D outline shape (Xcon,Ycon) seen from the chuck axis direction is obtained, a bevel path is re-calculated based on this 2-D outline shape. More preferably, the shape of the lens LE is measured again based on the corrected 2-D outline shape (Xcon,Ycon). This re-calculation process may be made after rough processing. The main controller 160 converts the 2-D outline shape (Xn,Yn) into polar coordinate data (Rcon, θn) (n=1, 2, . . . , N) with respect to the optical center. Based on the converted data, the main controller 160 operates the measurement portions 500, 520, as mentioned above. The main controller 160 measures once again the edge path in z-axis direction in the corrected 2-D outline shape (Xcon,Ycon)=(Rcon, θn) for the front and rear faces of the lens LE. In case the shift amount with the edge path on the front face of the lens LE is known from the first calculation of the bevel path, measurement of the edge path on the front face of the lens LE is sufficient.

In case the lens shape is not re-measured, the first measurement of the edge path on the front face of the lens LE is performed twice with changing the radial length near the bevel path so as to obtain the inclination angle of the lens front face bear the bevel. Therefore, the edge path in z-axis direction in the corrected 2-D outline shape (Xcon,Ycon) can be obtained without performing re-measurement.

Once the edge path of the lens LE is obtained, the bevel path is obtained as (Rcon, θn,Zcon) (n=1, 2, . . . , N). Then, the distances between data items of the bevel path are obtained and the obtained values are summed to obtain the 3-D circumference VL of the bevel. The bevel path is obtained so that the 3-D circumference VL of the bevel will almost match the 3-D circumference FL of the rim. In the apparatus, the bevel path is considered as size correction in the radial direction. That is, from the 3-D circumference VL of the bevel and the 3-D circumference FL of the rim, the size correction amount Δdl is obtained as $$\Delta dl=(VL-FL)/2\lambda$$

When the arithmetic operation of bevel path and correction of its circumference is complete, the lens LE is processed. In the first place, the main arithmetic operation portion 160 moves the carriage 701 so as to position the lens LE on the rough abrasive wheel 602*a* or the rough abrasive wheel 602*b*, and changes the center distance between the chuck shaft 702L, 702R and the shaft 601*a* while rotating the lens LE based on the corrected 2-D outline shape (Rcon, θn). When rough processing is complete, the main arithmetic operation portion 160 moves the carriage 701 so as to position the lens LE in the bevel groove of the finishing abrasive wheel 602*c*, and changes the center distance between the chuck shaft 702L, 702R and the shaft 601*a* while rotating the lens LE. In the bevel finishing, control of the center distance between the chuck shaft 702L, 702R and the shaft 601*a* is made while adding/subtracting the size correction amount Δdl for circumference correction, thereby processing a bevel having a 3-D circumference matching the 3-D circumference of the rime with high precision. Even in the optical center chuck processing, deformation caused by inclination of a 2-D outline shape due to a warp in the lens curve has been corrected, which assures a precise match of the machine shape with the rim shape.

While conversion from the frame pupillary distance FPD to the distance between centers FPD on a datum line and correction of the pupillary distance PD are obtained by measuring the left and right rims on the measuring apparatus 2 in the foregoing description, the rim warp angle (datum line inclination angle) α1 may be separately measured and input to the system for measurement of either the left or right rim. Although it is preferable that correction of a 2-D outline shape described referring to FIG. 12 uses the corrected distance ΔPD, even in case the pupillary distance PD cannot be corrected in the measurement of a single rim and the nose-side shift amount in the layout of optical center is used without correction, the above approach improves the precision of processing when compared with the related art method.

While the 2-D outline shape input from the measurement apparatus 2 is the projection shape in the direction of the rim warp with negligible deformation error in the correction of the 2-D outline shape mentioned above, a projection shape onto a plane perpendicular to the front direction of the rim or a projection shape in a predetermined direction may be used instead. In accordance with the measurement result of the edge path and in which direction the 2-D outline shape is projected, the inclination angle with respect to the chuck axis direction is obtained, and the 2-D outline shape is positioned in the inclination angle direction and corrected to a projection shape onto a plane perpendicular to the chuck axis direction.

For example, in case a 2-D outline shape as a projection shape in the front direction is used, the curve sphere of an edge path or a temporary bevel path is obtained to calculate the inclination angle an in the front projection direction with respect to the chuck axis direction. The inclination angle may be obtained as an angle formed by a straight line passing through the point OPD and the center Ov of the bevel curve sphere and the front direction referring to FIG. 11. Same as the foregoing example, by projecting a 2-D outline shape onto the bevel curve sphere from the direction of the inclination angle, the 3-D shape is re-calculated and converted into coordinates using the chuck axis direction as a reference in order to correct the 3-D shape to a shape seen from the chuck axis direction. Or, more simply, a 2-D outline shape is arranged at a position slanted by the inclination angle an with respect to the chuck axis direction and the 2-D outline shape is projected onto a plane perpendicular to the chuck axis direction in order to obtain a corrected 2-D outline shape. In this way, various modifications may be made to the invention and those modifications are included in the invention as long as the technical philosophy of the invention is followed.

What is claimed is:

1. An eyeglass lens processing apparatus for processing a periphery of an eyeglass lens to fit the eyeglass lens into a rim of an eyeglass frame, comprising:

a chuck shaft that chucks and holds the lens;

an input portion that inputs a 2-D outline shape which is a projection shape of the rim in its warp direction and a layout of an optical center of the lens with respect to the 2-D outline shape;

an edge measurement portion that measures a path of an edge position of the lens chucked and held by the chuck shaft based on the input 2-D outline shape and the input layout of the optical center; and an arithmetic operation portion that obtains an inclination angle of the measured edge path or a temporary bevel path obtained based on the measured edge path with respect to a center axis of the chuck shaft, obtains a corrected 2-D outline shape which is a projection shape onto a plane perpendicular to the center axis of the chuck shaft based on the obtained inclination angle and the input 2-D outline shape, and obtains a final bevel path to form a bevel in the periphery of the lens chucked and held by the chuck shaft at the optical center based on the obtained corrected 2-D outline shape.

2. The eyeglass lens processing apparatus according to claim 1, wherein the arithmetic operation portion obtains a curve sphere of the edge path or the temporary bevel path, obtains a 3-D shape formed on the curve sphere by projecting the 2-D outline shape onto the curve sphere from a direction of the inclination angle to convert the 3-D shape into coordinates using a direction of the center axis of the chuck shaft as a reference based on the layout of the optical center and the inclination angle, and obtains the corrected 2-D outline shape by projecting the obtained 3-D shape onto the plane perpendicular to the center axis of the chuck shaft.

3. The eyeglass lens processing apparatus according to claim 2, wherein the arithmetic operation portion corrects the layout of the optical center to a layout seen from the direction of the center axis of the chuck shaft based on the curve sphere and the inclination angle and determines a reference point for projecting the 2-D outline shape onto the curve sphere based on the corrected layout.

4. The eyeglass lens processing apparatus according to claim 1, wherein the arithmetic operation portion arranges the 2-D outline shape inclined by the inclination angle with respect to the central axis of the chuck shaft and obtains the corrected 2-D outline shape by projecting the arranged 2-D outline shape onto the plane perpendicular to the center axis of the chuck shaft.

5. The eyeglass lens processing apparatus according to claim 1, wherein the edge measurement portion re-measures the path of the edge position of the lens chucked and held by the chuck shaft at the optical center based on the obtained corrected 2-D outline shape and the arithmetic operation portion obtains the final bevel path based on the re-measured edge path.

6. An eyeglass lens processing apparatus for processing a periphery of an eyeglass lens to fit the lens into a rim of an eyeglass frame, comprising:

a chuck shaft that chucks and holds the lens;

an input portion that inputs a 2-D outline shape which is a projection shape of the rim in a predetermined direction and a layout of an optical center of the lens with respect to the 2-D outline shape;

an edge measurement portion that measures a path of an edge position of the lens chucked and held by the chuck shaft based on the input 2-D outline shape and the layout of the optical center; and an arithmetic operation portion that obtains an inclination angle of a projection direction of the 2-D outline shape with respect to a center axis of the chuck shaft based on the measured edge path, obtains a corrected 2-D outline shape which is a projection shape onto a plane perpendicular to the center axis of the chuck shaft based on the 2-D outline shape arranged in a direction of the obtained inclination angle, and obtains a bevel path to form a bevel in the periphery of the lens chucked and held by the chuck shaft at the optical center based on the obtained corrected 2-D outline shape.

7. The eyeglass lens processing apparatus according to claim 6, wherein the edge measurement portion re-measures the path of the edge position of the lens chucked and held by the chuck shaft at the optical center based on the obtained corrected 2-D outline shape and the arithmetic operation portion obtains the bevel path based on the re-measured edge path.

* * * * *